US010907569B2

(12) United States Patent
Elie et al.

(10) Patent No.: US 10,907,569 B2
(45) Date of Patent: Feb. 2, 2021

(54) SYSTEMS AND METHODS FOR A CYLINDER BORE COATING FILL MATERIAL

(71) Applicant: Ford Global Technologies, LLC, Dearborn, MI (US)

(72) Inventors: Larry Dean Elie, Ypsilanti, MI (US); Hamed Ghaednia, West Bloomfield, MI (US); Clifford E. Maki, New Hudson, MI (US); Timothy George Beyer, Troy, MI (US); Arup Kumar Gangopadhyay, Novi, MI (US); James Maurice Boileau, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/446,369

(22) Filed: Jun. 19, 2019

(65) Prior Publication Data

US 2020/0400093 A1 Dec. 24, 2020

(51) Int. Cl.

| | |
|---|---|
| ***F02F 1/10*** | (2006.01) |
| ***C23C 4/02*** | (2006.01) |
| ***F02F 1/00*** | (2006.01) |
| ***B05D 1/36*** | (2006.01) |

(52) U.S. Cl.

CPC ..... *F02F 1/004* (2013.01); *B05D 1/36* (2013.01); *F02F 2200/00* (2013.01)

(58) Field of Classification Search

CPC . C23C 4/02; C23C 28/021; C23C 4/01; F02F 1/18; F02F 3/10

See application file for complete search history.

(56) References Cited

U.S. PATENT DOCUMENTS

| | | | | |
|---|---|---|---|---|
| 5,592,927 | A | 1/1997 | Zaluzec et al. | |
| 5,648,620 | A * | 7/1997 | Stenzel | B22D 19/08 123/193.5 |
| 7,753,023 | B2 * | 7/2010 | Takami | B22D 19/0009 123/193.2 |
| 8,726,874 | B2 | 5/2014 | Whitbeck et al. | |
| 10,180,114 | B1 * | 1/2019 | Maki | B24C 1/003 |
| 2005/0235944 | A1 * | 10/2005 | Michioka | C23C 28/021 123/193.2 |
| 2015/0219039 | A1 * | 8/2015 | Weber | B05D 3/12 123/193.2 |
| 2016/0025035 | A1 * | 1/2016 | Kadoshima | F16J 1/01 252/62 |
| 2017/0260926 | A1 * | 9/2017 | Maki | B05D 1/08 |
| 2018/0058370 | A1 | 3/2018 | Amano | |

(Continued)

FOREIGN PATENT DOCUMENTS

GB 2558414 A 7/2018

*Primary Examiner* — Long T Tran

(74) *Attorney, Agent, or Firm* — Geoffrey Brumbaugh; McCoy Russell LLP

(57) ABSTRACT

Methods and systems are provided for filling surface pores of a cylinder inner surface coating with one or more fill materials to provide desired material and performance properties. In one example, a cylinder for an engine includes an inner surface including a coating having a plurality of surface pores, at least a portion of the plurality of surface pores filled with one or more fill materials, the one or more fill materials configured to decrease friction, increase tribofilm formation, adjust heat transfer, decrease material deposit, and/or decrease run-in duration.

19 Claims, 4 Drawing Sheets

(56) References Cited

U.S. PATENT DOCUMENTS

| | | | | |
|---|---|---|---|---|
| 2019/0017463 | A1 | 1/2019 | Maki et al. | |
| 2019/0186407 | A1* | 6/2019 | Burns | F02F 1/004 |
| 2019/0277220 | A1* | 9/2019 | Horigome | F02F 1/004 |
| 2019/0292644 | A1* | 9/2019 | Volpe | F02F 1/004 |

* cited by examiner

SYSTEMS AND METHODS FOR A CYLINDER BORE COATING FILL MATERIAL

FIELD

The present description relates generally to methods and systems for at least partially filling at least some surface pores present in a cylinder bore coating with one or more fill materials.

BACKGROUND/SUMMARY

Engine blocks (cylinder blocks) include cylinder bores that house pistons of an internal combustion engine. Engine blocks may be cast, for example, from cast iron or aluminum. Aluminum is lighter than cast iron, and may be chosen in order to reduce the weight of a vehicle and improve fuel economy. Aluminum engine blocks may include a liner, such as a cast iron liner. If liner-less, the aluminum engine block may include a coating on the bore surface. Liner-less blocks may receive a coating (e.g., a plasma coated bore process) to reduce wear and/or friction.

The inner surface of each cylinder bore is machined prior to coating so that the surface is suitable for use in automotive applications with suitable wear resistance and strength. The machining process may include roughening the inner surface, applying a metallic coating to the roughened surface, honing the metallic coating to obtain a finished inner surface, and cleaning the inner surface to remove burrs and debris. The coating and/or honing processes may generate surface pores in the inner surfaces, which may act to retain oil or other lubricants, decreasing friction between the pistons and the inner surfaces of the cylinder bores.

One example approach for coating a cylinder bore or liner surface of an engine block is shown by Maki et al. in U.S. Publication No. 2019/0017463. Therein, a coating is sprayed on to an engine bore surface, the coated surface is honed to create a honed surface region that includes a plurality of surface pores, and the honed surface region is cleaned in one or more areas of the honed surface region to remove material from at least some of the plurality of surface pores.

However, the inventors herein have recognized potential issues with such systems. As one example, while the cleaning process described above may only be performed in certain areas of the honed surface region (e.g., areas where high piston velocity is desired) in order to generate areas having different porosity, pores may still be present in certain areas where porosity is not necessarily desired. Further, these areas, which may include piston ring reversal regions near/at top dead center and bottom dead center, may benefit from additional performance enhancing materials not typically present in the cylinder bore or liner surface.

In one example, the issues described above may be addressed by a cylinder for an engine, including an inner surface including a coating having a plurality of surface pores, at least a portion of the plurality of surface pores filled with one or more fill materials, the one or more fill materials configured to decrease friction, increase tribofilm formation, adjust heat transfer, decrease material deposit, and/or decrease run-in duration.

As one example, the one or more fill materials may include solid lubricants such as graphite, molybdenum disulfide, silver nanoparticles, copper-based powders and pastes, copper oxide nanoparticles, tungsten disulfide, copper, and graphene, which may decrease friction and/or increase tribofilm formation. The fill material(s) may fill surface pores in only select regions, such as the ring reversal regions, which may allow the surface pores in the middle region of the cylinder to remain open for accommodating lubricating oil, at least in some examples. In doing so, varying amounts of friction/lubrication may be provided along the cylinder length, facilitating longer-term retention of lubrication, especially in cold start-up conditions, which will reduce the friction and metal-to-metal contact between the rings and cylinder liner, leading to less wear and/or damage to the engine. Further, the top ring reversal region may be exposed to combustion, which may lead to challenges in retaining oil in the top ring reversal region. By providing the solid lubricants in the pores at the top ring reversal region, friction at the top ring reversal region may be reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
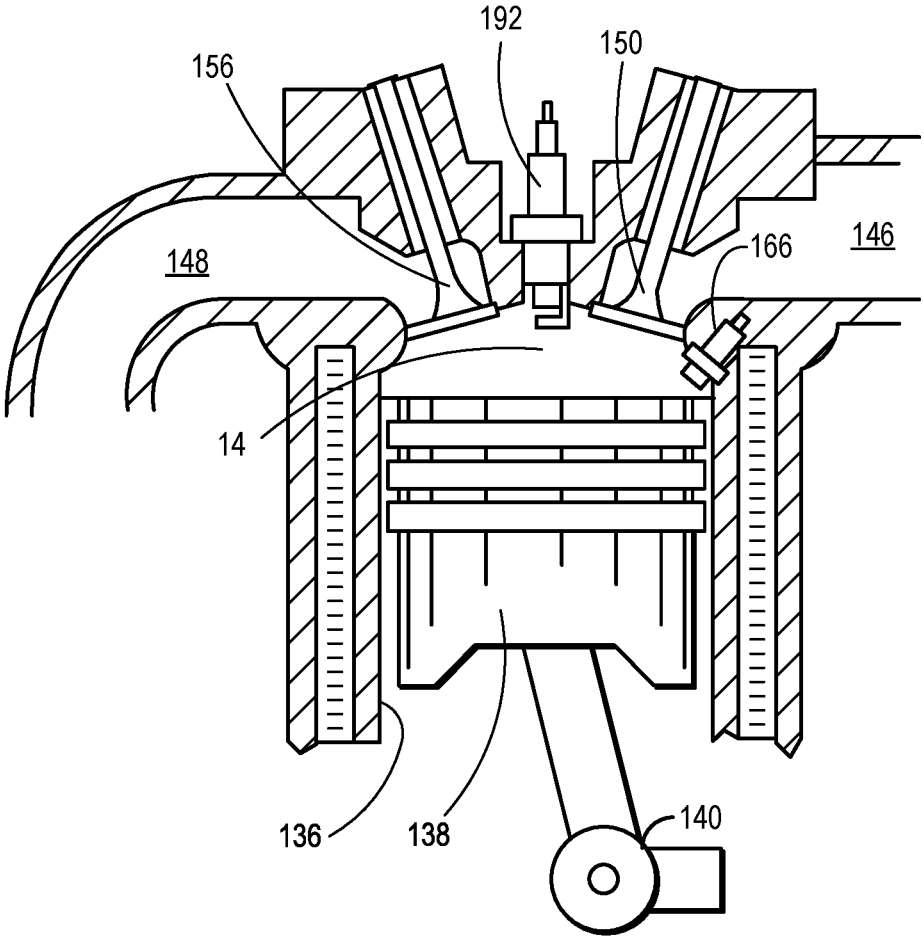
FIG. 1 schematically shows an example of a cylinder of an engine.

The use of surface porosity to enhance oil retention in cylinder bores is a superior alternative approach to traditional honing. This method allows a potential low cost method of enhanced oil retention that boosts lubrication as well as reduces roughness that reduces friction. However, the velocity and contact pressure of piston ring pack contact versus bore wall changes as a function of distance along the cylinder bore. Therefore, a variable porosity structure may be tailored for different regions of bore stroke. In general, it is desired that the majority of the bore has a higher amount of pores, while the upper and lower ring reversal region of the bore has a lower amount of revealed pores. While various ways of achieving a variable porosity coating are available, all of the proposed methods achieved this goal by selectively creating pores in some regions. Therefore, the proposed methods do not take full advantage of the pores in the top and bottom ring reversal regions.

The embodiments disclosed herein focuses on using pores in various regions as a way to introduce performance enhancing materials to the bore wall. In this approach, the pores in certain regions, such as the top and bottom regions, can be filled with compounds to boost local performance of the system. For example, low friction and wear materials may be implanted in the pores to enhance contact performance in boundary lubrication. This material could be a suitable type of element, compound, solid lubricant or any other low friction or wear material. This is notable since the ring/bore contact experiences highest thermal and mechanical load at the top dead center position. Therefore, introduction of such material can help the system have a better performance in terms of friction and wear.

As another example, materials to enhance tribofilm formation at top and bottom ring reversals (TDC and BDC) may be implanted in the pores. Tribofilms are thin films that lubricants deposit on surfaces to reduce friction and wear. These films are a byproduct of oil/bore interaction and usually take time to form. Therefore the surfaces can experience high wear and friction before the film is fully form. These films may be formed faster or with a better quality in the presence of some chemical compounds, such as zinc dialkyldithiophosphate (ZDTP) and phosphonium-based ionic liquids. Therefore, pores can be utilized to locally introduce these materials and enhance tribofilm formation at TDC and BDC.

Further, materials to adjust heat transfer (especially at the TDC where bore is exposed to combustion heat) may be implanted in the pores. The materials introduced in the pores at this area may have either conductive or insulating effects depending on the overall system design to tune the bore wall temperature and maximize the engine efficiency. Examples of such materials may include copper-, silver-, or aluminum-based particles.

Materials to reduce deposit formation (especially in the top dead center (TDC) where the bore is exposed to combustion exhaust gas) may be introduced into the pores in other examples. Exhaust gas can deposit unwanted materials in form of soot or other chemical compounds on the bore wall and rings. The formation of deposits can be reduced or eliminated in the presence of certain materials. These materials include, but are not limited to, mixtures and compounds such as ZDTP and calcium sulphonates. Further, the materials may include catalytic materials such as platinum, palladium, and rhodium. The pores can be used to introduce these materials to the bore wall.

Materials to reduce the run-in process at ring/bore interface and help the system achieve steady state friction earlier may be introduced into the pores. Engines demand a certain run-in process to reach optimal performance in terms of friction (e.g., lower friction and better fuel economy). The run-in process may be shortened in the presence of certain materials, chemical compounds or particles. For example, fast run-in may be achieved by virtue of having a mirror finish surface, generated in the honing process which creates additional pores. However, hard material like tungsten carbide or ceramics like silicon nitride, silicon carbide, alumina etc., may be infiltrated in the pores, which can facilitate faster removal of asperities from the ring surface. This can help achieve an even faster run-in. These materials however, may increase friction. Pores can be used to introduce these materials to the bore wall to achieve optimal performance earlier.

Turning now to FIG. 1, an example of a cylinder 14 of an internal combustion engine 10 is illustrated, which may be included in a vehicle, stationary power generating device, or other platform. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one drive wheel of a vehicle via a transmission, for example.

Cylinder 14 of engine 10 can receive intake air via one or more intake passages, such as intake air passage 146. Intake air passage 146 can communicate with other cylinders of engine 10 in addition to cylinder 14, at least in some examples. A throttle including a throttle plate may be provided in the engine intake passages for varying the flow rate and/or pressure of intake air provided to the engine cylinders.

Exhaust passage 148 can receive exhaust gases from other cylinders of engine 10 in addition to cylinder 14. One or more emission control devices (e.g., a three-way catalyst, a NOx trap, various other emission control devices, or combinations thereof) may be included in exhaust passage 148 to treat emissions in the exhaust gas before the exhaust gas is released to atmosphere. Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by a controller via an actuator. Similarly, exhaust valve 156 may be controlled by the controller via an actuator. The positions of intake valve 150 and exhaust valve 156 may be determined by respective valve position sensors (not shown). The valve actuators may be of an electric valve actuation type, a cam actuation type, or a combination thereof.

Cylinder 14 can have a compression ratio, which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. An ignition system can provide an ignition spark to combustion chamber 14 via spark plug 192 in response to a spark advance signal from the controller, under select operating modes.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system that may include one or more fuel tanks, fuel pumps, and fuel rails. Fuel injector 166 is shown coupled directly to cylinder 14 for injecting fuel directly therein in proportion to the pulse width of a signal received from the controller via an electronic driver. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of the fuel system via a high pressure fuel pump and a fuel rail. In some examples, cylinder 14 may additionally or alternatively receive fuel from a fuel injector arranged in intake passage 146, in a configuration that provides what is known as port fuel injection (hereafter referred to as "PFI") into the intake port upstream of cylinder 14.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Engine 10 may be comprised of a cylinder block including a plurality of cylinder bores, each bore defining a bottom portion of a cylinder (a top portion of each cylinder may be defined by a cylinder head that houses the intake and exhaust valves, spark plug, and/or fuel injector). The engine block body may be formed of a suitable material, such as aluminum, cast iron, magnesium, or alloys thereof. In some examples, the engine block is a liner-less engine block. In these examples, the bores may have a coating thereon. In some examples, the engine block may include cylinder liners inserted into or cast-in to the bores. The liners may be a hollow cylinder or tube having an outer surface, an inner surface, and a wall thickness.

If the engine block parent material is aluminum, then a cast iron liner or a coating may be provided in the cylinder bores to provide the cylinder bore with increased strength, stiffness, wear resistance, or other properties. For example, a cast iron liner may be cast-in to the engine block or pressed into the cylinder bores after the engine block has been formed (e.g., by casting). In another example, the aluminum cylinder bores may be liner-less but may be coated with a coating after the engine block has been formed (e.g., by casting). In another embodiment, the engine block parent material may be aluminum or magnesium and an aluminum or magnesium liner may be inserted or cast-in to the engine bores.

Accordingly, the bore surface of the cylinder bores may be formed in a variety of ways and from a variety of materials. For example, the bore surface may be a cast-iron surface (e.g., from a cast iron engine block or a cast-iron liner) or an aluminum surface (e.g., from a liner-less Al block or an Al liner). The term bore surface or cylinder inner surface as used herein may refer to a surface of a liner-less block or to a surface of a cylinder liner or sleeve that has been disposed within the cylinder bore (e.g., by interference fit or by casting-in). Thus, the combustion chamber walls 136 may comprise a cylinder bore of a liner-less block, or the combustion chamber walls 136 may comprise a cylinder liner or sleeve. In either case, the combustion chamber walls 136 may be coated with a substance (or mix of substances) or otherwise formed to have desired material properties, in order to reduce friction between the piston and combustion chamber walls, increase oil retention, and so forth, as will be explained in more detail below.

Figure 2:
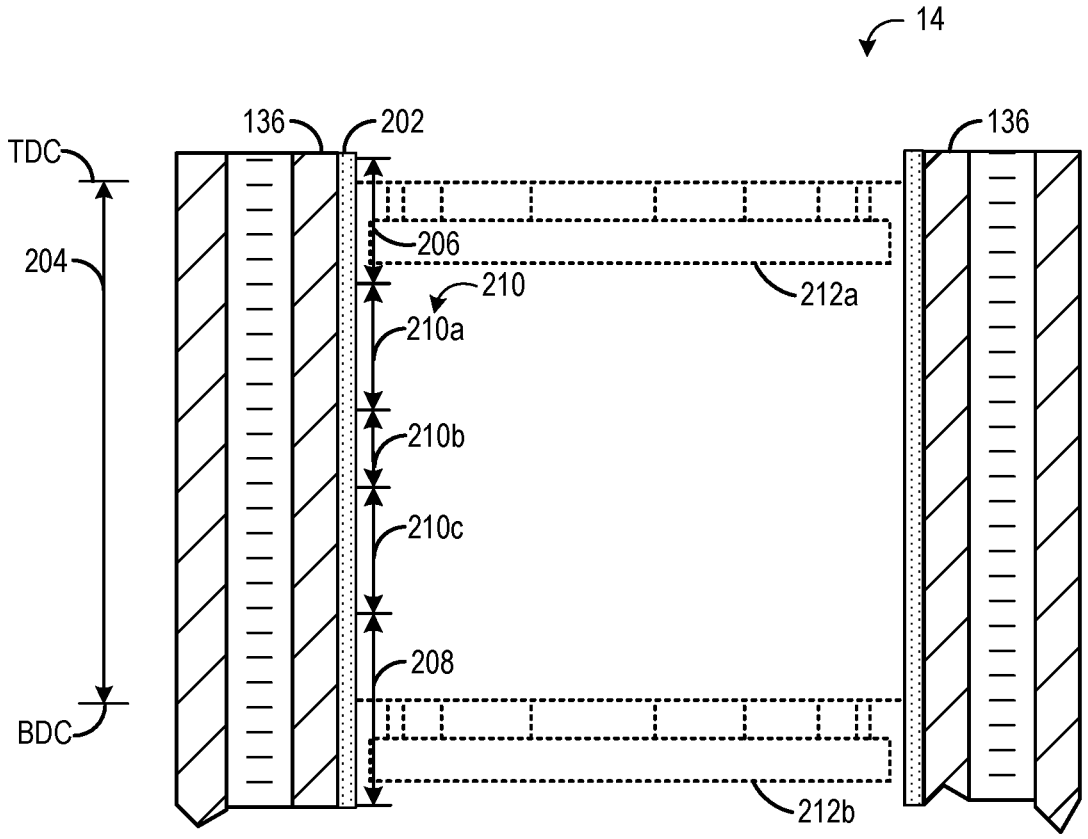
FIG. 2 is a magnified view of a portion of the cylinder of FIG. 2.

FIG. 2 shows a magnified view of a portion of cylinder 14, specifically a portion of combustion chamber walls 136 in a piston-housing region (e.g., the region of the walls 136 along which piston 138 is configured to move). The combustion chamber walls 136 are coated with a coating 202 that extends along a piston region 204. The piston region 204 extends from a topmost position that corresponds to a top dead center (TDC) of the piston to a bottommost position that corresponds to a bottom dead center (BDC) of the piston. FIG. 2 shows a portion of piston 138 in dashed lines at two positions, a first position 212*a* where the top surface/ring pack of the piston is at TDC and a second position 212*b* where the top surface/ring pack of the piston is at BDC. The coating 202 may be coupled to and/or formed as part of the combustion chamber walls 136 along an entirety of the piston region 204, though it is to be understood that the coating 202 may extend along the combustion chamber walls outside of the piston region 204 (e.g., above and/or below the piston region 204), at least in some examples.

The coating 202 may be a suitable coating that provides sufficient strength, stiffness, density, wear properties, friction, fatigue strength, and/or thermal conductivity for an engine block cylinder bore. In at least one embodiment, the coating may be an iron-based or steel-based coating. Non-limiting examples of suitable steel compositions may include any AISI/SAE steel grades from 1010 to 4130 steel. The steel may also be a stainless steel, such as those in the AISI/SAE 400 series (e.g., 420). However, other steel compositions may also be used. The coating is not limited to irons or steels, and may be formed of, or include, other metals or non-metals. For example, the coating may be a ceramic coating, a polymeric coating, or an amorphous carbon coating (e.g., DLC or similar). The coating type and composition may therefore vary based on the application and desired properties. In addition, there may be multiple coating types in the cylinder bore. For example, different coating types (e.g., compositions) may be applied to different regions of the cylinder bore and/or the coating type may change as a function of the depth of the overall coating (e.g., layer by layer).

In general, the process of applying the coating 202 and finalizing the bore dimensions and properties may include several steps. First, the bore surface may be prepared to receive the coating. As described above, the bore surface may be a cast engine bore or a liner (cast-in or interference fit). The surface preparation may include roughening and/or washing of the surface to improve the adhesion/bonding of the coating. Next, the deposition of the coating may begin. The coating may be applied in any suitable manner, such as spraying. In one example, the coating may be applied by thermal spraying, such as plasma transferred wire arc (PTWA) spraying. The coating may be applied by rotational spraying of the coating onto the bore surface. The spray nozzle, the bore surface, or both may be rotated to apply the coating. The deposition parameters may be adjusted (e.g., by a controller) to produce varying levels of porosity in the coating. The adjustments may be made while the coating is being applied or the application may be paused to adjust the parameters. Additional layers of the coating may be applied using the same or further adjusted deposition parameters.

After the coating is applied, it may be honed to a final bore diameter according to specified engine bore dimensions. In some embodiments, an optional mechanical machining operation, such as boring, cubing, etc., may be performed prior to honing in order to reduce the amount of stock removal during honing. The honing process may include inserting a rotating tool having abrasive particles into the cylinder bore to remove material to a controlled diameter. The abrasive particles may be attached to individual pieces called honing stones, and a honing tool may include a plurality of honing stones. The honing process may include one or more honing steps. If there are multiple honing steps, the parameters of the honing process, such as grit size and force applied, may vary from step to step. The honing process may remove material from the coating and provide a highly cylindrical bore wall (e.g., combustion chamber wall) having the final bore diameter. As described herein, the coating surface may be the surface that results from the honing process, and may be referred to as the honed surface region.

As used herein, the honed surface region may be a region in the coating that includes the surface of the coating and a relatively small depth beneath the surface, for example, up to 5 μm, 10 μm, 25 μm, or 50 μm beneath the surface. It has been found that the porosity (e.g., average surface porosity) of the honed surface region can generally be described by two types of pores, which may be referred to as primary and secondary pores. Primary pores may be those that are generated during the coating process (e.g., spraying). These pores (e.g., porosity and size) may be generally controlled by the coating parameters. Secondary pores may be those that are created or generated after the coating has been deposited.

During the honing process, material that is removed from the coated bore surface or a burr or edge of a pore may be smeared over the pore surface or may fill in the pore. This may result in a lower surface porosity and significantly reduce the retention capability of the pore for oil and/or the pore-filling material (that will be described below). Accordingly, a cleaning process may be performed to clean the bore/liner surfaces to reveal the pores. The cleaning process may include performing one or more cleaning passes of the bore coating surface. In one embodiment, the cleaning process may include a high-pressure water spray. The spray may be controlled into a spray pattern, such as a fan spray pattern (e.g., a substantially 2D spray pattern). Other cleaning methods that may be suitable include ice blasting (e.g., water- or CO2-based), brushing, or a very fine abrasive media. These methods are examples, however, and not intended to be limiting.

In some examples, the cylinder bore may include specific regions with more drag reduction needs, thus more lubricant retention demand, such that regions of higher surface porosity, or more pores revealed by cleaning, may be desired in those regions. In some examples, a selective cleaning process may be performed that removes material from pores in a controlled process to reveal pores to certain degrees in certain areas of the cylinder bore or regions of the honed surface region, resulting in a tailored surface texture. The selective cleaning process uncovers or exposes debris filled or smeared over pores during the honed cylinder surface operation to a certain degree or in certain regions of the bore surface. For example, the cylinder bore surface where the piston ring pack travels is made of specific regions, some benefiting from a higher average surface porosity more than others. By tailoring the cleaning process to specific regions, lubricant and/or the pore-filling material (that will be described below) deposition can be improved exactly where demanded by piston ring travel. By selectively cleaning the honed surface region, surface texturing can be tailored to properly expose pores on the coated surface.

Returning to FIG. 2, the coating 202 may include different regions as a function of the cylinder height/piston travel. In the example shown in FIG. 2, the coating may include an upper region 206, a lower region 208, and a middle region 210. The upper region 206 may correspond to the upper ring reversal region, where the ring pack of the piston (which is the region of the piston that makes contact with the combustion chamber walls 136/coating 202) slows on its way from BDC to TDC, reaches TDC, and then reverses direction and moves back down toward BDC. Likewise, the lower region 208 may correspond to the lower ring reversal region, where the ring pack of the piston slows on its way from TDC to BDC, reaches BDC, and then reverses direction and moves back up toward TDC.

The middle region 210 may be disposed between the upper and lower regions. The middle region 210 may comprise a majority of the cylinder liner or bore wall, or cover a certain height of the cylinder bore according to the crank angle of the piston. Similar to crank angle, the upper and lower regions 206, 208 and middle region 210 may cover areas (e.g., height ranges) of the bore surface that correspond to where the piston has a certain velocity. For exemplary purposes, crank angles are discussed for the regions, but other properties may apply as well. The upper and lower regions 206, 208 may or may not be the same height, and may reflect on the upper and lower rings. As one non-limiting example, starting from BDC, the lower region 208 may extend from 0° C.A to approximately 40° C.A, the middle region 210 may extend from approximately 40° to 140° C.A, and the upper region may extend from approximately 140° to 180° C.A. In other embodiments, the upper, lower, and middle regions may have heights that differ from those disclosed above. For example, the upper and lower regions nay have different heights. Further, as shown in FIG. 2, lower region 208 may extend beyond the piston region 204. For example, lower region 208 includes a top portion that extends from 0° to 40° C.A, as described above, and a bottom portion that extends an equivalent height below BDC.

The middle region 210 may include three sub-regions, a first sub-region 210*a*, a second sub-region 210*b*, and a third sub-region 210*c*. In the example shown in FIG. 2, the first sub-region 210*a* and the third sub-region 210*c* may have the same height, which may be larger than a height of the second sub-region 210*b*. The second sub-region 210*b* may the mid-stroke region that extends along the region of the cylinder inner surface that contacts the piston when the piston is half-way between TDC and BDC. In a non-limiting example, starting from BDC, the third sub-region 210*c* may have a height that extends from 40° to 80° C.A, the second sub-region 210*b* may have a height that extends from 80° to 100° C.A, and the first sub-region 210*a* may have a height that extends from 100° to 140° C.A.

In some examples, the surface porosity (e.g., average surface porosity) of the upper and lower regions 206, 208 may have an average surface porosity of up to 3%. For example, the upper and lower regions may have a porosity of, but is not limited to, up to 2.5%, 2%, or 1.5%. As disclosed herein, "average surface porosity" may refer to a surface porosity, or a percentage of the surface of the coating that is made up of pores (e.g., empty space or air, prior to introduction of lubricant and/or the pore-filling material that will be described below). In some examples, the surface porosity of the middle region 210 may be greater than the surface porosity of the upper and/or lower region(s). In one embodiment, the middle region 210 may have a surface porosity (e.g., average surface porosity) of at least 2%, for example, at least 3%, 4%, 5%, 6%, 7%, 8%, 9%, 10%, 15%, or 20%. In other examples, the surface porosity of the upper, lower, and middle regions may be the same. For example, the average surface porosity across the entire coating may be in a range of 3-20%.

The size or diameter of the pores, the pore depth, and/or the pore distribution in the low and high honed surface porosity regions may be the same or may be different based on the selective cleaning process revealing the pores in the region(s). In one embodiment, the mean or average pore sizes of the upper/lower regions and the middle region may be the same or similar, while the surface porosities are different based on the selective cleaning process. The average pore sizes of the upper/lower regions and the middle region may be from, but is not limited to, 0.1 to 750 μm, or any sub-range therein. In another embodiment, the pores may be selectively revealed during the cleaning process based on diameter or pore depth, but is not limited to, about 10% to 95%, about 15% to 90%, about 20% to 85%, or about 25% to 80% of size/depth to obtain a selective surface texture. In another embodiment, the pore distribution based on the surface porosity may be selectively revealed based on the region(s). Certain areas may have a higher percentage of pores revealed. For example, pores in the upper and lower regions 206, 208 may be revealed to a surface porosity of about 0.1% to 3%, whereas the middle region 210 may be revealed to a surface porosity of about 2% to 20%. In other examples, cleaning may be performed on the entire coating/cylinder inner surface such that the lower, upper, and middle regions all have a revealed surface porosity of about 2% to 20%. To achieve the surface porosities, the cleaning process may reveal pores within the selected regions based on the diameter or pore depth, for example of about 10% to 95%. In other embodiments, the pore size/depth may remain uniform throughout the regions, but more pores may be selectively revealed in the middle region 210, compared to the upper and lower regions 206, 208, to achieve the desired surface porosity.

At least some of the pores formed in the coating may be filled with one or more fill materials to provide desired performance. For example, the one or more fill materials may be configured to decrease friction, increase tribofilm formation, adjust heat transfer, decrease material deposit, and/or decrease run-in duration. The one or more fill materials may include one or more of graphite, molybdenum disulfide, silver nanoparticles, copper-based powders and pastes, copper oxide nanoparticles, tungsten disulfide, copper, and graphene, which may decrease friction and/or increase tribofilm formation. By increasing tribofilm formation, the run-duration of the engine may be reduced. (The run-in duration may include the duration after engine manufacture and during use of the engine where tribofilms are formed along the cylinder bore surfaces due to the presence of lubricating oil and the reciprocating motion of the piston.) Additionally or alternatively, the one or more fill materials may include one or more of copper-, aluminum-, and silver-based particles, which may adjust (e.g., increase) heat transfer. Additionally or alternatively, the one or more fill materials may include platinum, palladium, and rhodium, which are catalytic and may act to reduce the deposition of soot or other material on the coating of the cylinder inner surface. The fill material may be a different material than the material comprising the coating, at least in some examples.

One example fill material includes copper-based anti-seizure compounds. Based upon copper powders, these copper-based anti-seizure compounds may be used in applications where components are exposed to temperatures of greater than 1000° C. to prevent seizure in high temperature. A second example fill material is molybdenum sulfide (MoS2), which is a stable dry lubricant; often the MoS2 particles are <100 um in size. MoS2 may be combined with titanium nitride to form a very stable composite coating that can be applied via chemical vapor deposition.

By filling at least some of the pores with a fill material, additional desired properties may be achieved. In particular, it may be advantageous to fill pores in region(s) where a high surface porosity is not desired or beneficial, such as regions where retention of oil is challenging or regions where oil does not sufficiently contribute to friction reduction. As explained above, high surface porosity to retain oil may not be beneficial in the upper and lower regions of the cylinder inner surface, where the piston reverses direction. Thus, at least in some examples, the surface pores in the upper and/or lower region may be filled with one or more fill materials, which may act to provide desired material/performance properties, such as enhanced friction reduction.

In some examples, pores in different regions of the cylinder inner surface may be filled with different materials. For example, the top and bottom dead center regions (e.g., upper and lower regions) may be filled with solid lubricants (MoS2) to reduce friction while regions between the dead center regions and mid stroke may be filled with hard particles to facilitate faster break-in. However, at least some pores in at least some regions may be maintained free of (or at least partially free of) the one or more fill materials to facilitate oil retention in regions of the cylinder bore/liner.

In a first example, the exposed surface pores of upper region 206 and lower region 208 may be filled with one or more fill materials, such as MoS2, tungsten disulfide, copper or copper-based particles, silver-based particles, or other fill materials. The exposed surface pores of middle region 210 may be left exposed, in order to facilitate oil retention. In some examples, the exposed surface pores of second sub-region 210*b* of middle region 210 may also be filled with the fill material described above, leaving first sub-region 210*a* and third sub-region 210*a* free from fill material.

In a second example, the exposed surface pores of upper region 206 and lower region 208 may be left exposed, and thus are free from fill material. The exposed surface pores of middle region 210 may be filled with one or more fill materials, such as MoS2, tungsten disulfide, copper or copper-based particles, silver-based particles, or other fill materials. In some examples, only the surface pores of the first sub-region 210*a* and the third sub-region 210*c* of the middle region 210 may be filled with the one or more fill materials and the surface pores of the second sub-region 210*b* may not be filled with the one or more fill materials.

The selection of which fill material(s) to fill the surface pores with as well as the selection of which region(s) of the cylinder inner surface are to be subject to the process to fill the surface pores with the one or more fill materials may be based on the engine configuration and/or desired material properties to be imparted by the one or more fill materials. For example, if enhanced heat transfer is desired, the pores of the upper region may be filled with copper-, silver-, and/or aluminum-based particles, while other regions may be free from the fill material. In another example, if increased friction reduction is desired, any region where the addition of solid lubricant may assist in friction reduction may be selected as a target region for pore filling with the one or more fill materials.

Figure 3:
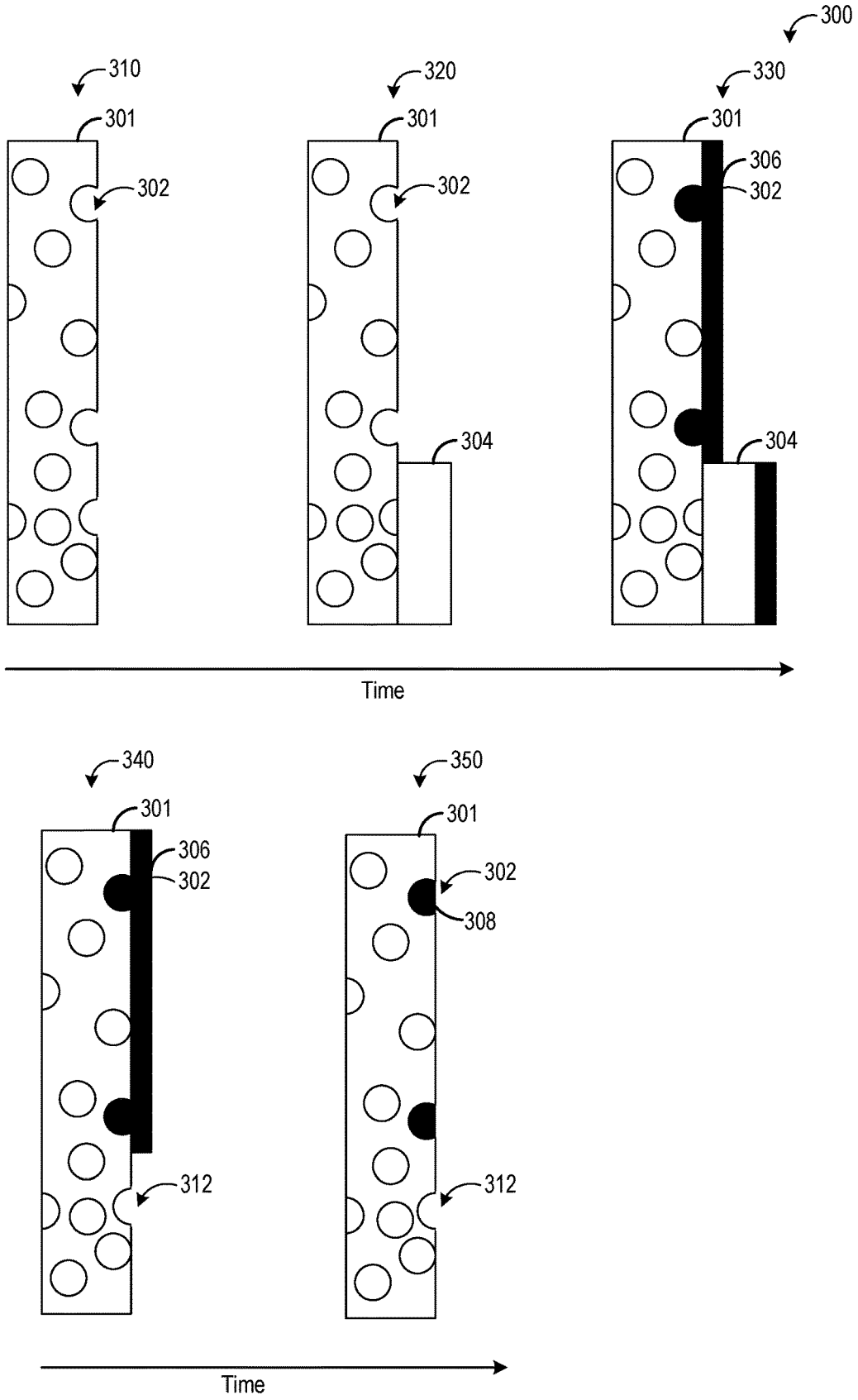
FIG. 3 shows an example process for filling surface pores of a cylinder bore surface with a fill material.

FIG. 3 schematically shows an example process 300 for filling surface pores of a cylinder inner surface coating. FIG. 3 shows five example segments of the process, shown in FIG. 3 as a function of time. A first segment 310 of the process includes preparing a coating 301 on a cylinder inner surface, where the coating includes surface pores (such as surface pore 302) configured to receive a fill material. As used herein, a surface pore includes an opening/pocket at the surface of the coating that may house air, oil, or other material, where the opening is exposed to the inner volume of the cylinder. The coating 301 may include additional pores within the coating, but the pores within the coating that are not exposed to the cylinder inner volume are not considered surface pores. The coating may be comprised of steel, stainless steel, ceramic, or other suitable material. The coating may be prepared by applying the coating as explained above (e.g., spraying the coating on the inner surface of the cylinder bore or cylinder liner), honing the coating until a desired cylindrical volume is achieved, and cleaning the honed surface to reveal the surface pores. For example, the cleaning process may include glow discharge in the case of sputter coatings, or chemical etches in the case of most other coatings. In some examples, only the middle region of the coating may be cleaned, resulting in a lower average surface porosity at the upper and lower regions of the coating/inner surface. In other examples, the entire piston region of the cylinder may be cleaned, such that the upper, middle, and lower regions each have approximately the same average surface porosity. Coating 301 is a non-limiting example of coating 202 of FIG. 2.

After the coating 301 is applied to the liner or bore inner surface, a mask 304 is applied to one or more regions of the coating during a second segment 320 of the process 300. The mask may be comprised of plastic, metal, fiberglass, silicon, fabric, and/or other suitable materials and may be removably attached to the coating via adhesive, fasteners, or other mechanism. The mask 304 is sized and shaped to shield the one or more regions of the coating from the fill material that will be applied in a later segment of the process, leaving one or more additional regions of the coating unmasked. As an example, the mask 304 may mask a middle region of the coating, leaving the upper region and the lower region unmasked.

In a third segment 330 of the process 300, one or more fill materials 306 are applied to the coating 301 and mask 304. The one or more fill materials may include graphite, molybdenum disulfide, silver nanoparticles or other silver-based particles, copper oxide nanoparticles or other copper-based particles, aluminum-based particles, graphene, tungsten disulfide, and/or other materials that are not oil-soluble and deliver desired material properties, such as reducing friction or reducing deposit build-up. The one or more fill materials may be applied using a spraying process, such as thermal spray, chemical vapor deposition (CVD), physical vapor deposition (PVD), cold spray, etc. As shown at the third segment 330, the fill material 306 fills the exposed surface pores of the coating 301, such as pore 302.

For thermal spray, the fill material may be in the form of discrete powders particles that are smaller in size than the pore opening. In addition, the gas pressure may be controlled so that the particles impact and are loosely attached mechanically inside the pore. This will allow the building up a layer of the fill material to the upper extremity of the pore that will be available to flow out during engine operation. In examples, the fill material may be applied by a cold spray process with a rotating gun using air as a carrier. The pressure may be adjusted so that the particles are pushed into the pore, and gets locked in on the roughness inside the pore.

For CVD and PVD processes, the cylinder bore or liner is placed into a vacuum chamber. Addition, most PVD processes are out-of-site, which would necessitate a complex rotating cathode to focus the plasma stream on the inner cylinder bore/liners. Accordingly, CVD and PVD may be challenging, due to the large size of most engine blocks relative to vacuum chambers and the costly and complex parts that may be needed. Thus, another potential process would be to use a compressed gas jet to physically spray the fill material onto the bore liner surface. This would be simple and inexpensive; in addition, a suspension fluid could be added to carry the particles through the sprayer to the bore liner surface.

After the fill material has been applied, the mask 304 is removed at a fourth segment 340 of the process. The mask may be removed via a washing process, by peeling the mask off from the coating, or by removing/undoing any fastening mechanisms fixing the mask to the coating/inner surface. As shown in the fourth segment 340, the masked region includes surface pores (e.g., surface pore 312) that are free from fill material. Further, the coating in the masked region is also free from fill material.

At a fifth segment 350 of the process, the fill material 306 that is present on the coating 301 is removed to expose the coating 301. The fill material may be removed via washing, honing, or other process. For example, a physical wiping process could be performed to abrade or rub off the coating, where a cylinder-shaped component with a cloth surface is pushed into/through the bore to clean off the surface without removing the material in the pores. In some examples, the cloth could then be covered with a solvent that breaks down any carrier/suspension fluid. Further, a light honing process may be performed if needed. If the coating is applied with a CVD/PVD process, then the wiping method may not be practical, and a fine machining operation (like a "superfinishing" operation that removes only a few microns) may be utilized. Upon removal of the fill material that is present on the coating, the fill material in the surface pores remains, such that each surface pore of the unmasked region(s) includes fill material. For example, the abrading or wiping process discussed above may not reach into the pores, thus maintaining the fill material intact. FIG. 3 shows surface pore 302 filled with pore fill material 308 at segment 350. By removing the fill material from the coating and leaving the fill material in only the pores, additives in the lubricant may interact with the ferrous-based cylinder inner surface to help provide wear protection and friction reduction. The fill materials may not be ferrous-based and thus this benefit would be lost if the fill materials were left on the coating of the cylinder inner surface.

Figure 4:
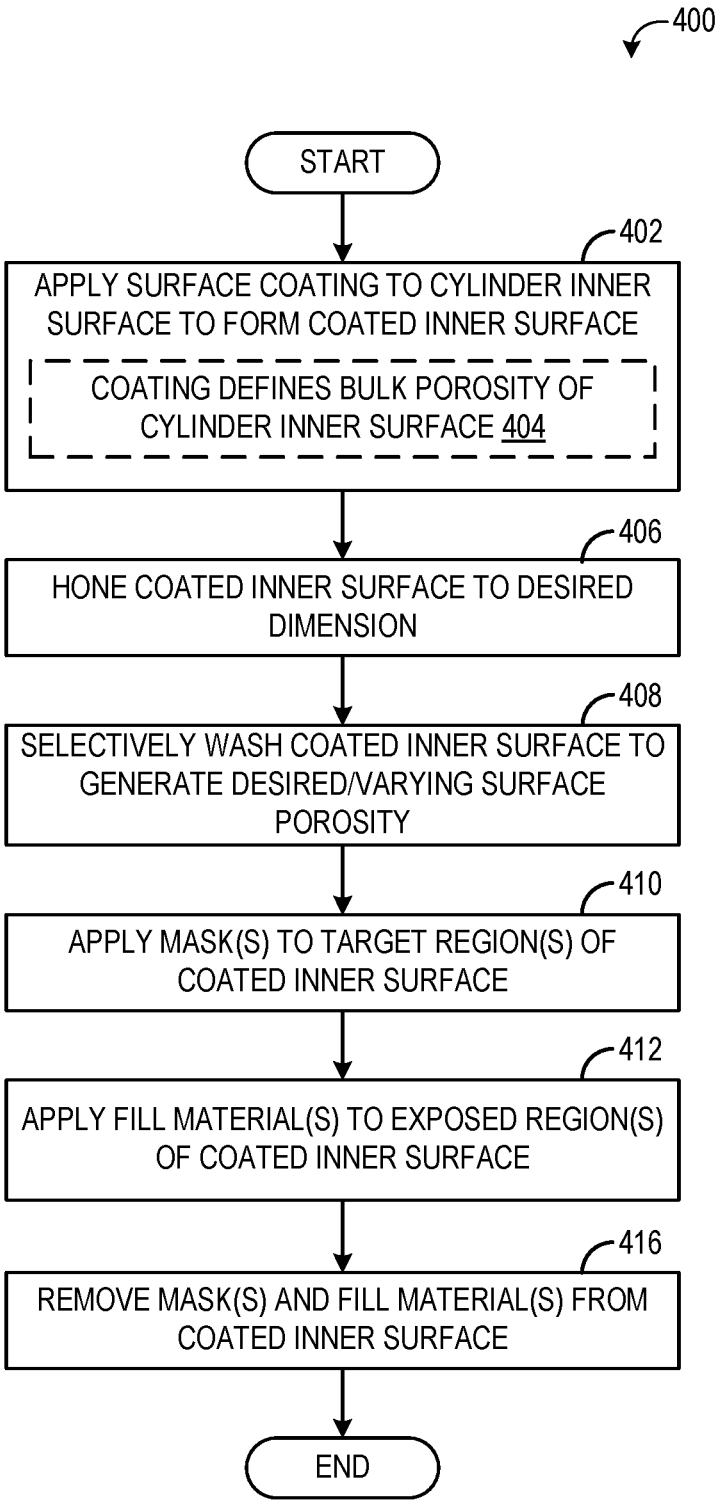
FIG. 4 is a flow chart illustrating an example method for applying a coating having surface pores to a cylinder inner surface and filling at least some of the surface pores with a fill material.

FIG. 4 is a flow chart illustrating a method 400 for applying a coating to an inner surface of a cylinder bore or liner and filling surface pores in one or more regions of the coating with a fill material. Method 400 may be performed in order to apply a coating, such as coating 202 of FIG. 2 or coating 301 of FIG. 3, on a cylinder bore or liner inner surface, such as the inner surface of the cylinder 14 of FIG. 1. A fill material, such as fill material 306 of FIG. 3, may be applied to one or more regions of the coating, and the fill material may at least partially fill one or more surface pores formed in the coating, such as surface pore 302 of FIG. 3, such that the surface pores are filled with fill material, such as pore fill material 308 of FIG. 3.

At 402, method 400 includes applying a surface coating to a cylinder inner surface to form a coated inner surface. The coating may be comprised of steel, stainless steel, ceramic, or other suitable material that may impart desired physical properties, such as providing sufficient strength, stiffness, density, wear properties, friction, fatigue strength, and/or thermal conductivity for an engine block cylinder bore. As indicated at 404, the coating may define a bulk porosity of the cylinder inner surface. As explained above with respect to FIG. 2, the coating may be sprayed or otherwise deposited on the cylinder bore or liner wall such that a first amount of pores are formed in and on the coating.

At 406, the coated inner surface (e.g., coating) is honed to a desired dimension. As explained above, the honing process may reveal pores, cause nucleation of additional pores, and cause some surface pores to be filled with material (e.g., particles of the coating that are removed during the honing may be pushed into open surface pores, thereby at least partially filling some surface pores). Accordingly, to reveal filled pores, the coated inner surface is selectively washed to generate a desired/varying surface porosity, as indicated at 408. As explained above with respect to FIG. 2, the washing process may remove any coating material that has filled surface pores, causing the surface pores to be free from material. Further, the washing may cause additional pores to be revealed/nucleated. Further still, the washing process may be performed only in some regions of the coated inner surface and not in all regions. For example, the washing process may only be performed on a middle region of the coated inner surface, leaving the surface pores in the upper and lower regions to be somewhat or fully filled with the coating material. By doing so, the middle region may have a higher average porosity than the upper or lower regions. However, in some examples, all of the coated inner surface may be washed, such that the entire cylinder inner surface has the same average porosity.

At 410, a mask(s) is applied to a target region(s) of the coated inner surface, such as mask 304 of FIG. 3. The mask may shield the target region from further material application. The target region that is masked may be the middle region of the coated inner surface, although additional or alternative regions may be masked. In some examples, the masking may be dispensed with. At 412, one or more fill materials are applied to the exposed/unmasked region(s) of the coated inner surface. As explained above with respect to FIG. 3, the fill material(s) may be sprayed on to the coating in the unmasked region(s). The spray process may be controlled to achieve a target level of fill in the surface pores. For example, the fill operation may be conducted so that the minimum amount of material required to fill all pores is sprayed onto the cylinder bore surface. Further, in some examples such as when the fill material includes catalytic materials to reduce deposits, fully filling the pores may not be necessary, and thus the pores may be partially filled, which may leave additional pore volume for retaining oil. In other examples, such as when the fill material is adapted to enhance heat transfer, the pores receiving the fill material may be fully filled or at least a majority of the pore volume may be filled. At 416, the mask(s) is removed, and the fill material on the coated inner surface is removed to reveal the coated inner surface, while retaining the fill material that is within the surface pores. As explained above with respect to FIG. 3, the fill material on the coated inner surface may be physically abraded or rubbed off, chemically cleaned off, and/or honed off to reveal the coated inner surface, which may be smooth, robust and resistant to wear, and facilitate interaction with additives in the lubricant to improve engine performance. Method 400 then ends FIGS. 1-3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The technical effect of filling surface pores of a coated inner surface of a cylinder with one or more fill materials is to decrease friction between a piston and the cylinder inner surface, increase tribofilm formation, adjust heat transfer, decrease combustion material deposition, and/or decrease run-in duration.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A cylinder for an engine, comprising:

an inner surface comprised of an upper region, a lower region, and a middle region disposed intermediate the upper region and the lower region, the inner surface including a coating having a plurality of surface pores, at least a portion of the plurality of surface pores filled with one or more fill materials, the one or more fill materials configured to decrease friction, increase tribofilm formation, adjust heat transfer, decrease combustion material deposit, and/or decrease run-in duration.

2. The cylinder of claim 1, wherein the one or more fill materials include graphite, molybdenum disulfide, silver nanoparticles, copper-based powders or pastes, copper, tungsten disulfide, copper oxide nanoparticles, and/or graphene.

3. The cylinder of claim 1, wherein the one or more fill materials include copper-, aluminum-, and/or silver-based particles.

4. The cylinder of claim 1, wherein the one or more fill materials include platinum, palladium, and/or rhodium.

5. The cylinder of claim 1, wherein only surface pores present in the upper region and/or lower region are filled with the one or more fill materials.

6. The cylinder of claim 1, wherein all surface pores present in the middle region are free from the one or more fill materials.

7. The cylinder of claim 1, wherein the middle region includes a first sub-region, a second sub-region, and a third sub-region, the second sub-region disposed intermediate the first sub-region and the third sub-region, and wherein surface pores present in the upper region, the lower region, and the second sub-region are filled with the one or more fill materials and surface pores present in the first sub-region and the third sub-region are free from the one or more fill materials.

8. The cylinder of claim 1, wherein only surface pores present in the middle region are filled with the one or more fill materials.

9. The cylinder of claim 1, wherein the middle region has a different average surface porosity than an average surface porosity of the upper region and/or lower region.

10. The cylinder of claim 1, wherein the coating is free of the fill material other than in the at least a portion of the plurality of surface pores.

11. The cylinder of claim 1, wherein each surface pore of the at least a portion of the plurality of surface pores that is filled with the one or more fill materials is fully filled with the one or more fill materials.

12. A method, comprising:

forming a coating on an inner surface of a cylinder bore, the coating including a plurality of surface pores;

applying a mask to the coating;

applying a fill material to at least one unmasked region of the coating;

removing the mask after applying the fill material;

finishing the inner surface to reveal the coating in the at least one unmasked region, the finishing including maintaining the fill material in surface pores of the plurality of surface pores within the at least one unmasked region.

13. The method of claim 12, wherein the mask is applied before applying the fill material and the mask is removed before finishing the inner surface.

14. The method of claim 13, wherein applying the mask includes applying the mask to a middle region of the coating and wherein applying the fill material comprises applying the fill material to both an upper region of the coating and a lower region of the coating, the middle region positioned intermediate the lower region and the upper region.

15. The method of claim 12, wherein applying the fill material includes spraying the fill material on the at least one unmasked region of the coating.

16. The method of claim 12, wherein applying the fill material comprises applying one or more of graphite, molybdenum disulfide, silver nanoparticles, copper-based powders or pastes, copper oxide nanoparticles, graphene, and aluminum-based particles.

17. A cylinder for an engine, comprising:

a cylinder bore; and a piston configured to reciprocate within the cylinder bore, the cylinder bore including:

an inner surface including an upper region configured to circumferentially surround the piston when the piston is at top dead center, a lower region configured to circumferentially surround the piston when the piston is at bottom dead center, and a middle region positioned between the upper region and the lower region;

a coating on the inner surface, the coating having a plurality of surface pores; and fill material filling only surface pores of the plurality of surface pores in the upper region and/or lower region and not filling surface pores of the middle region.

18. The cylinder of claim 17, wherein the fill material includes one or more of graphite, molybdenum disulfide, silver nanoparticles, copper oxide nanoparticles, graphene, and aluminum-based particles.

19. The cylinder of claim 17, wherein an outer surface of the coating is free from the fill material, and wherein the coating is comprised of a different material than the fill material.

* * * * *